US005606757A

United States Patent [19]

Byington, Jr.

[11] Patent Number: 5,606,757

[45] Date of Patent: Mar. 4, 1997

[54] MULTIPURPOSE FENCE TOOL

[76] Inventor: Barney Byington, Jr., P.O. Box 675, Greenville, Fla. 32331

[21] Appl. No.: 433,140

[22] Filed: May 3, 1995

[51] Int. Cl.[6] ..... B25F 1/00

[52] U.S. Cl. ..... 7/117; 254/251

[58] Field of Search ..... 7/117; 140/123.5, 140/123.6, 123; 254/251, 243, 256, 261, 262

[56] References Cited

U.S. PATENT DOCUMENTS

| | | | |
|---|---|---|---|
| 513,816 | 1/1894 | Negus | 254/251 |
| 860,139 | 7/1907 | Johnson | 254/251 |
| 886,020 | 4/1908 | Sprague | 254/251 |
| 1,161,740 | 11/1915 | Smith | 140/123.6 X |
| 1,174,267 | 3/1916 | Naffziger | 7/117 |
| 1,581,306 | 4/1926 | Yelton | 140/123.5 |
| 1,922,706 | 8/1933 | Neptune | 254/251 |
| 2,501,500 | 6/1946 | Armond | 7/117 |
| 5,303,748 | 4/1994 | Haldemann | 140/123 |

*Primary Examiner*—D. S. Meislin
*Attorney, Agent, or Firm*—Carnes, Cona, and Dixon

[57] ABSTRACT

The present invention provides for a combination fence tool that includes a plurality of working implements. The tool includes a first attachment having an upper end with a curved edge and a lower end. A second attachment is pivotally attached to the first attachment. This second attachment includes a protruding portion which extends upwardly from a top area and a lower area which is secured to the upper end of the first attachment. This will provide for the protruding portion to be planar with the first attachment. A gap is located between the protruding portion and the curved edge to provide for the gap to receive wiring by providing for the gap to decrease in size at a forward end of the protruding portion and to increase in size at a rearward end as the second attachment is pivoted forward. This gap and forward movement of the second attachment provide for a wire splicer or wire stretcher. The second attachment further includes a pointed tip that extends forward from the upper area and a pointed tail which extend downwardly from the back and lower area of the second attachment. This point tip can be used as a wire cutter while the pointed tail is utilized as a staple remover. The tool device can include a handle that is adapted to be removably secured to the lower end of the first attachment.

12 Claims, 4 Drawing Sheets

MULTIPURPOSE FENCE TOOL

BACKGROUND OF THE INVENTION

1. Field of the Invention

The present invention relates generally to a fence tool and more particularly to a fence tool that can be utilized in order to perform a plurality of tasks.

2. Description of the Prior Art

Installing and maintaining a bar wire fence is a tedious and burdensome task. In order to provide an adequate service, the bar wire and the fence components are often susceptible to stretching via a wire stretcher, removing staples via a staple puller, cutting via a wire cutter, and connecting wire via a wire splicer. In order to accomplish all these task, an individual will often need a plurality of tools. The use of these tools can be cumbersome and bulky to carry.

What is needed is a tool that can aid and assist an individual who is working on a particular fence. Towards this end, a combination tool is disclosed in U.S. Pat. No. 5,303,748, issue to Haldemann. Haldemann discloses a pliers-type tool that includes a hammer head, staple puller, wire-gripping pincer, and a method of stretching wire. This tool does include a first body portion and a second body portion. The ends of the first and second body portions are pivotally attached for forming the handle of the device. These body portions provide for the device to have the appearance of conventional pliers. Though efficient, this tool disclosed in Haldemann does suffer some shortcomings. One such shortcoming is due to the shape of the handles. Since the hammer head is located on a side surface of one body portion, then both handles must be held in order to utilize the device. If not held, then the second body portion can freely rotate about the pivotal point of attachment and may cause injury to the user. The act of holding both the first body portion and the second body portion simultaneously must also occur when utilizing_the staple remover. The design and configuration of the first and second body portions provide for device of Haldemann to be awkward to utilize and control.

In U.S. Pat. 2,501,500 issue to Armond, there is disclosed a combination tool. This tool includes a first and a second handle. These handles each include an end to provide for the ends to be pivotally attached. This will provide for the first and second handles to be in a parallel relationship with each other. The use of the handles being pivotally attached, provides for a device that is more difficult and dangerous to utilize. When utilizing this device, the user can easily catch the skin on their hands or fingers between the first and second handles. Additionally, Armond includes an adjusting means for adjusting the tool to be used as pliers. This embodiment provides for the device to be tedious and time consuming to use, hence defeating its intended purpose.

None of these previous efforts, however, provide the benefits of a tool that can easily and quickly be utilized as intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for a combination tool that is used when working with a bar wire fence. The fencing tool of the present invention, includes a handle that is adapted to be removably secured to the device. The handle includes a top end and a bottom end. The top end is removably attachable to a first portion or first attachment. A second portion or second attachment is pivotally secured to the first portion or attachment. The design and configuration of the first and second portions provides for a tool that includes at least a staple puller, a wire cutter, a wire stretcher, and a wire splicer.

Accordingly, it is the object of the present invention to provide for a combination tool that will compactly combine at least four tools into a single device.

It is another object of the present invention to provide for a combination tool that can safely, quickly, and efficiently be utilized when a particular implement is desired.

A final object of the present invention, to be specifically enumerated herein, is to provide a combination tool in accordance with the preceding objects and which will conform to conventional forms of manufacture, be of simple construction and easy to use so as to provide a device that would be economically feasible, long lasting and relatively trouble free in operation.

Although there have been a few inventions related to a combination tool, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Fig, 1*a* is a side view of the combination tool of the present invention.

Similar reference numerals refer to similar parts throughout the several views of the drawings.

DESCRIPTION OF THE PREFERRED EMBODIMENTS

Figure 1A:
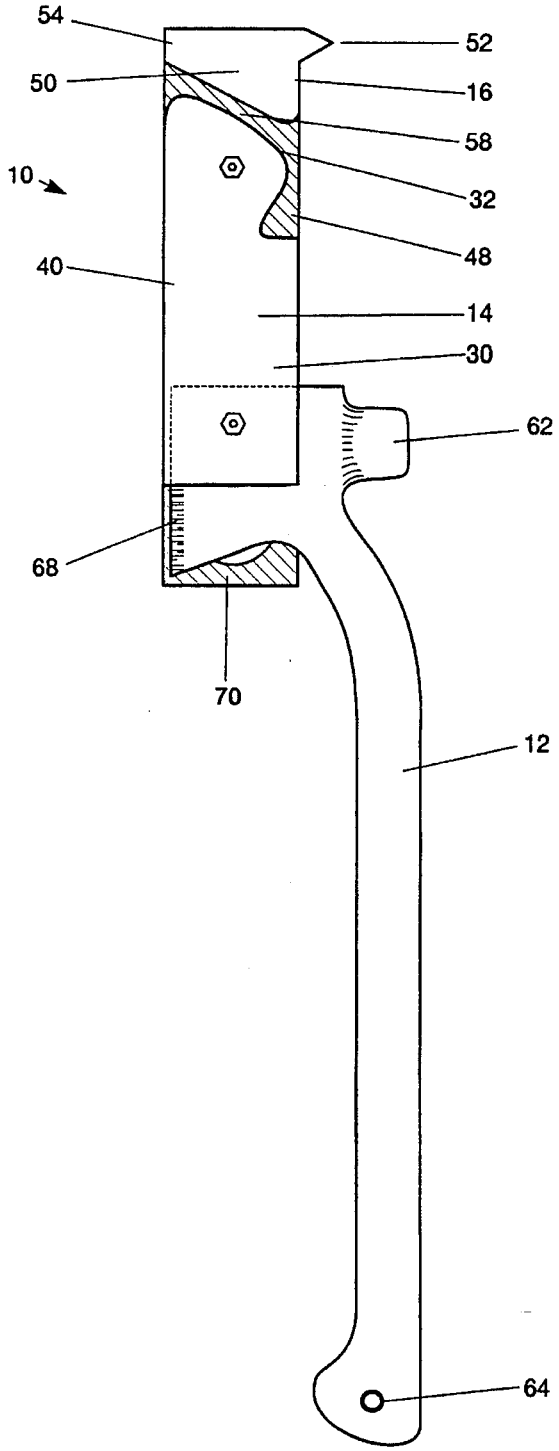
FIG. 1*b* is a back view of the combination tool of the present invention.
Figure 1B:
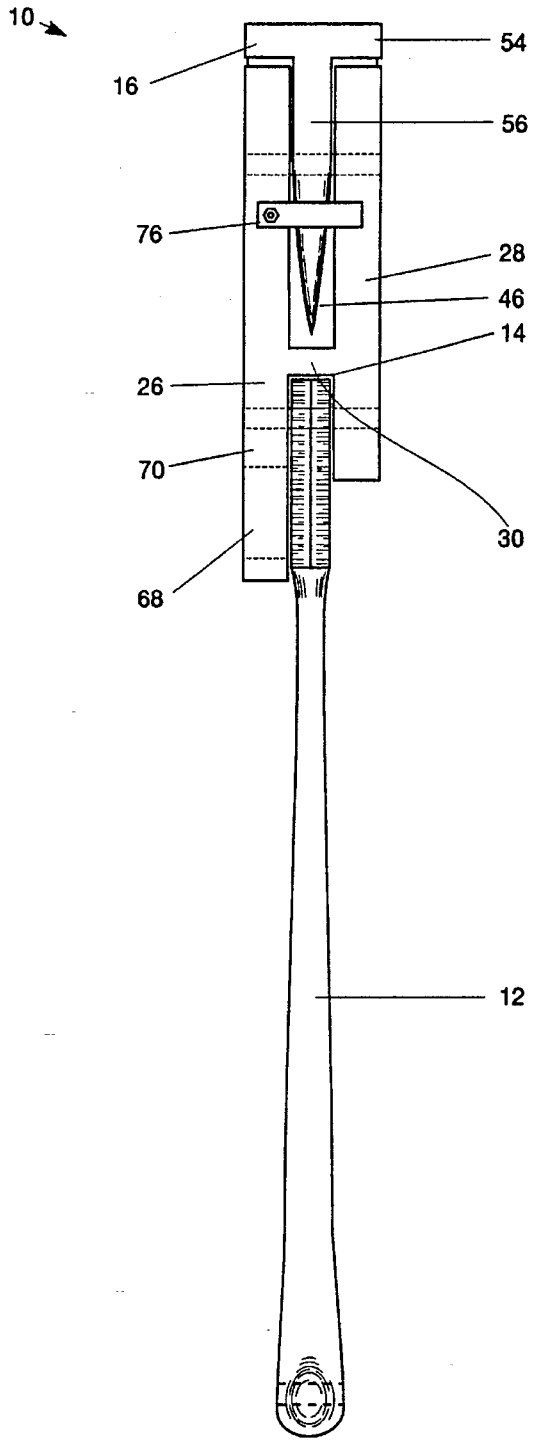

The tool 10 of the present invention, as illustrated in FIGS. 1*a* and 1*b*, consists of a handle 12, a first portion or a first attachment 14, and a second portion or second attachment 16.

Figure 2A:
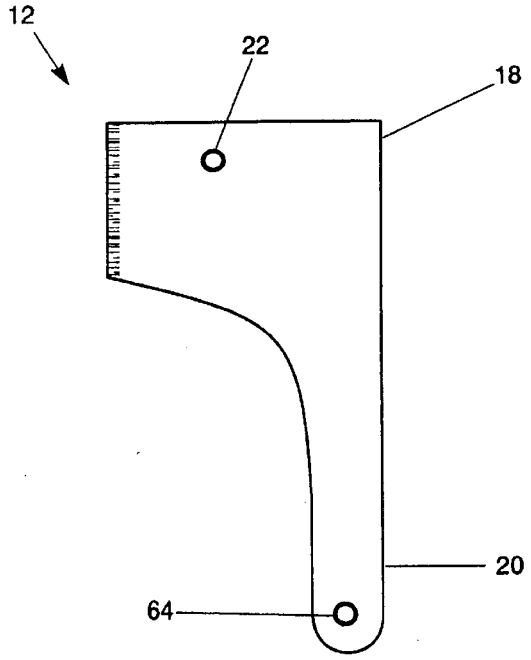
FIG. 2*a* is a side view of the first embodiment of the handle used the present invention.
Figure 2B:
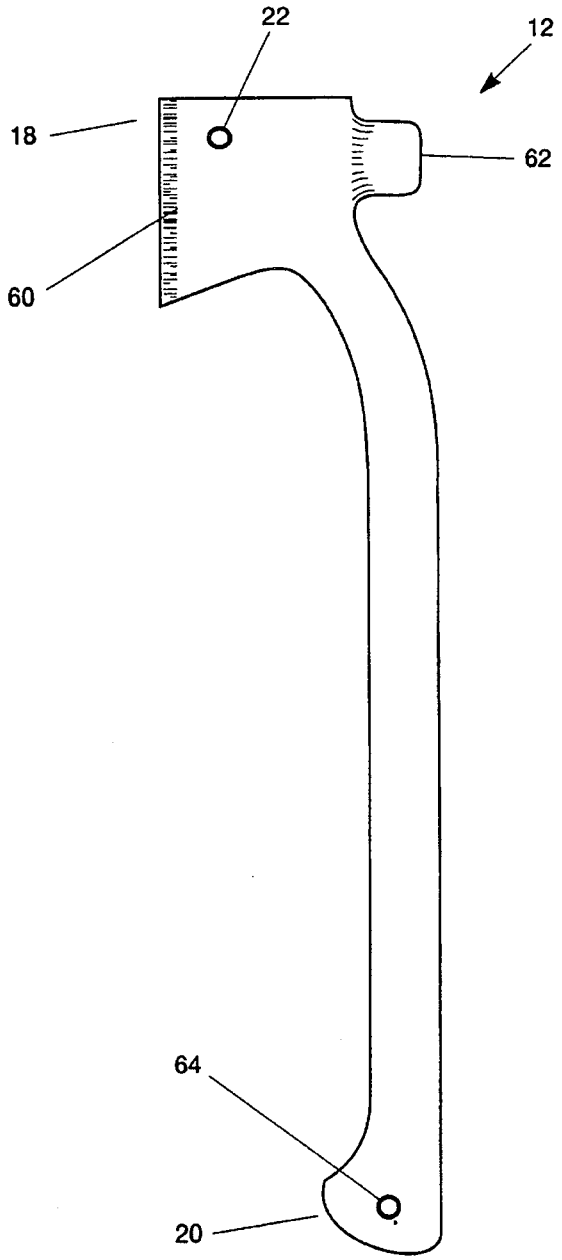
FIG. 2*b* is a side view of the second embodiment of the handle used in; the present invention.
Figure 3A:
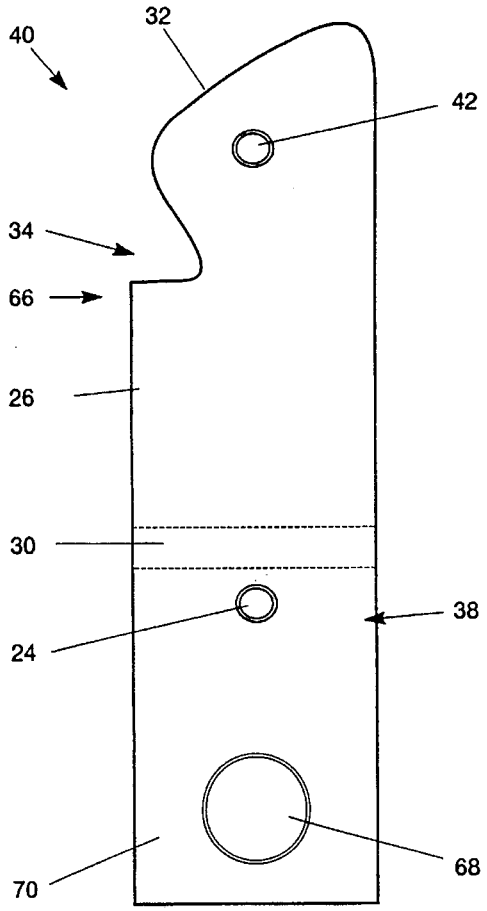
FIG. 3*a* is a side view of a first side of the first portion of the present invention.
Figure 3B:
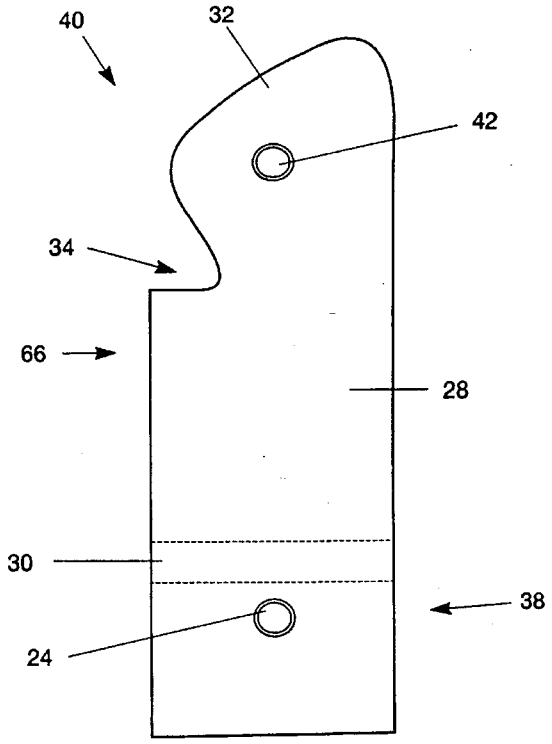
FIG. 3*b* is a side view of a second side of the first portion of the present invention.
Figure 3C:
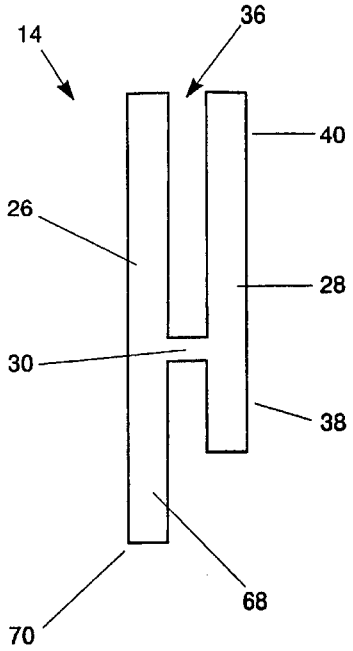
FIG. 3*c* is a front view of the first portion of the present invention.

The handle 12 is illustrated in further detail in FIGS. 2*a* and 2*b*. As seen in FIGS. 1*a*, 1*b*, 2*a*, and 2*b*, the handle 12 includes a top end 18 and a bottom end 20. The bottom end 20 is adapted to be held by a user. The top end 18 is received by the first attachment 14. This handle 12 is adapted to be removably secured to the first portion via an attachment means. This attachment means includes the combination of a first through hole 22 located on the handle 12 and a set of through holes 24 (illustrated in FIG. 3*a*–3*d*) located on the first attachment 14. This first hole 22 is adapted to align with a set of holes 24 which are located on the first attachment. This will permit for the first attachment or portion 14 to be affixed to the handle 12 via a securing means (illustrated in FIG. 1*a*, but not labeled). This securing means will extends through the first through hole 22 and the set of through holes 24. This securing means can be a conventional cap screw that extends through the holes and is locked into place via a conventional nut. The securing means can optionally include for the first through hole 22 and the set of holes 24 to be tapped (threaded) to enable the securing means to be a threaded rod that is adapted to be inserted therethrough and be maintained in a fixed position via a nut. It is noted that this handle can be optional, and if not attached does not affect the functionality or utility of the various implements of the tool 10 of the present invention.

Optionally, the first or second embodiment of the handle 12 may include an aperture 64 located at the bottom end 20 of the handle. This aperture 64 can act as a means of storing the tool 10 by enabling the user to hang the tool on a hook or the like via the aperture.

The handle 12 can also include a plurality of implements to provide for a handle that is versatile and practical. As seen in FIGS. 2*a* and 2*b*, the second embodiment of the handle 12, the top end 18 further includes a first side that includes a head 60, which is shaped as a hatchet (not labeled in FIG. 2*a*, but illustrated) and a second side that includes a hammer head 62.

The first attachment 14 is illustrated in further detail in FIGS. 1*a*, 1*b*, 3*a*, 3*b*, and 3*c*. As seen in these figures the first attachment 14 includes a first side wall 26 and a second side wall 28. The first side wall 26 is longer in length than the second side wall 28. The first and second side walls are attached, in a parallel relationship via a bar 30. This bar 30 provides for a gap 36 to exists between the first wall 26 and second wall 28. The lower area of the gap is adapted to receive the top end 18 of the handle 12 while the upper area of the gap 36 is adapted to receive the second attachment 16 of the tool 10 of the present invention. This arrangement and configuration will provide for the handle 12 to be received near the lower end 38 of each side wall while the upper end 40 of each side wall receives the second attachment 16.

Each side wall includes a through hole 24 to provide for a first set of through holes 24 to be located in the first attachment. This first set of through holes 24 is adapted to be aligned with the through hole 22 of the handle to permit and enable the handle 12 to be removably attached to the first portion.

Each side wall further includes a second hole 42 to provide for a second set of through holes 42 to be located in the upper end 40 of the first attachment. These holes 42 are adapted to be aligned with holes 44 (illustrated in FIG. 4) located on the second attachment of the tool 10. This will permit for the second attachment 16 to be pivotally secured to the first portion 14.

Additionally, the upper end 40 of each side (first wall 26 and second wall 28) of the first attachment 14 further includes a curved top 32 and an indented portion 34. The indented portion 34 is located on a front side 66 of each wall. This indented portion 34 serves as a natural stop for the second attachment when the second attachment is moving forward.

The first wall 26, as illustrated, may be longer in length. This will provide for the first wall 26 to include an elongated portion 70. This design is used to accommodate for a receiving means 68 to extend through the elongated portion 70. This receiving means 68 is adapted to receive and maintain a conventional wiring pulling device.

It is noted that this first attachment 14 does not need to include two side walls, but rather only one side wall is needed. Thereby, one side wall and bar 30 can be eliminated and not affect the functionality of the tool.

Figure 4:
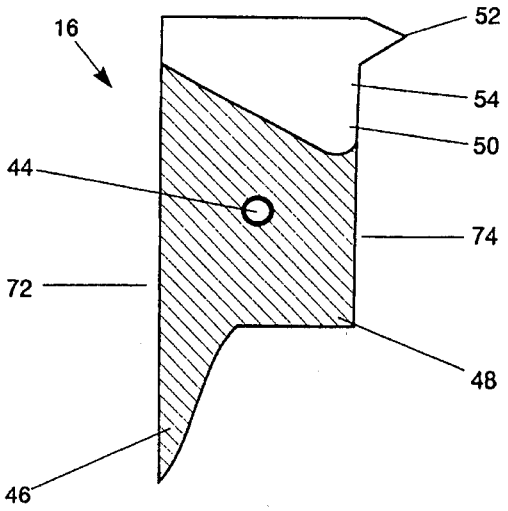
FIG. 4 is a side view of the second portion of the tool of the present invention.

The second attachment 16 is illustrated in FIGS. 1*a*, 1*b*, and 4. As seen in these figures, the second attachment 16 includes a pointed tail 46 which extends downwardly from an inward or lower area 48. This pointed tail 46 is located in the back 72 of the device. The second attachment 16 also includes a protruding guide portion 50 and a pointed end 52. The protruding guide portion 50 is located on the protruding area or upper area 54 and extends upwardly from the lower area 48 of the second attachment 16.

The through hole 44 is centrally located through the second attachment 16. This will provide for the second attachment to be pivotally secured to the first attachment via a conventional cap screw (illustrated in FIG. 1*a*, but not labeled) that is adapted to be inserted through the openings 42 located on the first side wall and second side wall of the first attachment (see FIGS. 3*a* and 3*b*) and through the opening 44 located through the second attachment. This cap screw is secured in placed via a conventional nut.

To maintain the second attachment in an upright and secured position, a securing means 76 is attached to the first section 14. This will provide for the second attachment to be in a locked and secured position when not in use. Hence, prohibiting the tail to extend outwardly from the device. When the second attachment is desired, then the securing means 76 is merely pivoted or pushed over, to provide for the second attachment to move freely about the pivot point. It is noted that when the device is in an upright position (FIG. 1*a*) the pointed tail will not extend outwardly from the front 74 of the device due to the unique design and configuration of the protruding portion 50 and the curved edge 32. The curve edge will act as a stop for the section attachment.

Since portion 50 extends outward from the second attachment, it will be aligned and planar to the curved top 32 of the first attachment. This will permit for the lower area 48 of the second portion to be inserted into the gap 36 of the first portion.

Once the second attachment 16 is secured to the first attachment 14, a gap 58 will inherently be formed between the protruding portion 50 and the curved top 32 of the first and second walls.

Various task can be performed by utilizing the combination tool of the present invention. One such tool located in this device is a staple puller. This staple puller is illustrated in further detail in FIG. 5. In order to use the staple puller, the second portion 16 is rotated so that the pointed tail 46 is perpendicular to the first attachment 14. This will provide for the pointed tail 46 to be used as a staple puller (see FIG. 5).

Figure 5:
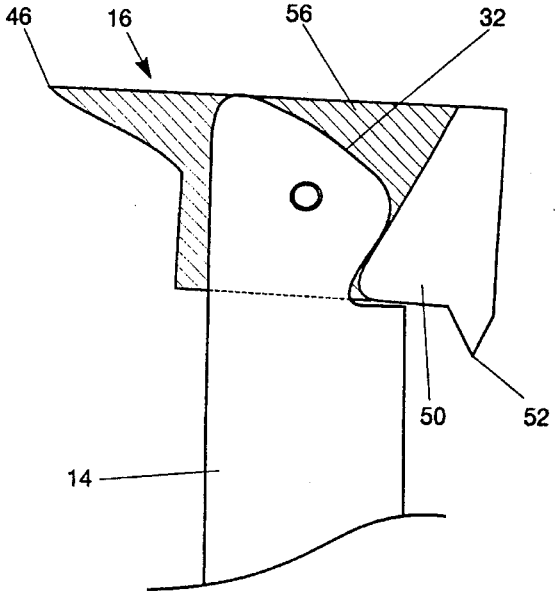
FIG. 5 is a impartial side view of the tool of the present invention positioned as a staple puller and wire cutter.

Another tool that is located in this device is a wire cutter and is also illustrated in FIG. 5. In order to use the wire cutter, the second portion 16 is rotated so that the pointed tail 52 is perpendicular to the first portion. This will provide for the pointed end 52 to be used as a wire cutter. In order to utilize the device, an individual merely places the wire under the end 52 and hits the side edge 56 of the device with a hammer.

Figure 6:
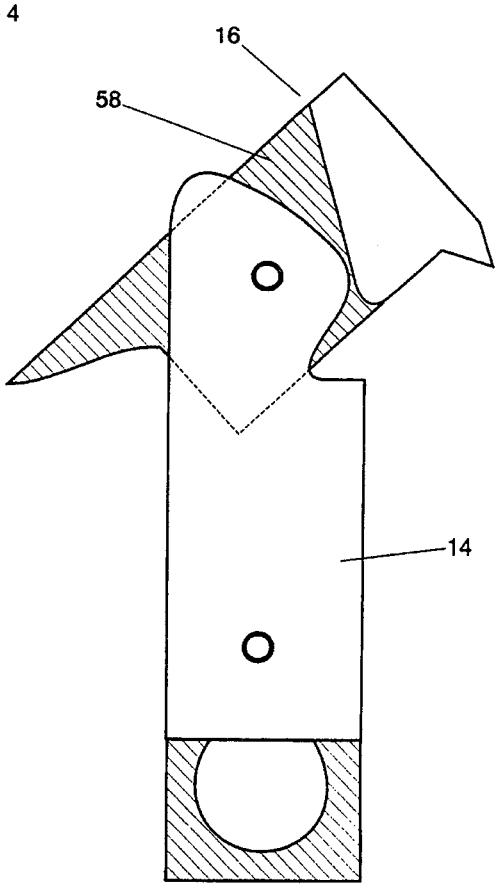
FIG. 6 is a partial side view of the tool of the present invention positioned as a wire splicer.

Yet another tool is a device for splicing wire and is illustrated in FIG. 6. In order to utilize this tool, the second portion is rotated to provide for the gap 58 (located between curved top 32 and protruding guide portion 50) to decrease in width from the top to the bottom. This will provide for a first end to decrease in size while a second end is decreasing in size. Thereby providing for a forward end of the protruding portion to decrease in size while an increase occurs at a rearward end of the protruding portion. The wires are inserted within the gap. The second attachment is then pulled downward to further decrease the distance of the gap and to provide a force onto the wires for splicing the wires.

Still another tool is a wire stretcher and is illustrated in FIG. 6. In order to use the wire stretcher, the second portion 16 is returned to its upright position. The wire is held in place via gap 58 that is located between the curved top 32 of the first attachment and the protruding guide portion 50. The second attachment is pulled down to provide for the first and second attachments to securing grasp and maintain the wire. Once maintained, the device is pulled, inherently pulling the wire. Additionally, opening 68 is adapted to receive a conventional wiring pulling device (not illustrated), such as a hitch of a tractor, to permit for the wire to be stretch.

The hatched head and hammer head located on the second embodiment of the present invention provide for additional implements that are located within the device of the present invention.

While the invention has been particularly shown and described with reference to an embodiment thereof, it will be understood by those skilled in the art that various changes in form and detail may be made without departing from the spirit and scope of the invention.

I claim:

1. A fencing tool comprising:

a first attachment and a second attachment;

said first attachment has an upper end and a lower end and said second attachment has an upper area and a lower area;

said upper end of said first attachment includes a curved edge and said second attachment is centrally and pivotally attached to said upper end of said first attachment;

a protruding portion extends upwardly from said upper area of said second attachment such that side walls of said protruding portion are planar to said first attachment;

a first gap is located between said protruding portion and said curved edge and said first gap is adapted to engage and receive wiring by providing said first gap to decrease in size at a forward end of said protruding portion and to increase in size at a rearward end of said protruding portion as said second attachment is pivoted forward; and said second attachment includes a front and a back and said front includes a pointed tip that extends forward from said upper area and a pointed tail extends downwardly from said lower area at said back area of said second attachment.

2. A fencing tool as in claim 1 wherein said first attachment includes an indented portion which is adapted to receive said forward end of said protruding portion for providing a natural stop for said protruding portion.

3. A fencing tool as in claim 2 wherein a handle is removably secured to said first attachment via a securing means.

4. A fencing tool as in claim 3 wherein said handle includes a hatchet head located at a first side.

5. A fencing tool as in claim 4 wherein said handle includes a hammer head located at an opposite side from said first side.

6. A fencing tool as in claim 1 wherein said first attachment includes a first wall and a second wall and said first wall and said second wall are attached in a parallel relationship via a bar for providing a second gap to exist between said first wall and said second wall, and said second gap located at said upper end of said first attachment receives said second attachment.

7. A fencing tool as in claim 6 wherein said second gap receives a handle at said lower end of said first attachment.

8. A fencing tool as in claim 7 wherein said handle is adapted to be removably secured to said first attachment and said handle further includes a hatchet head located at a first side.

9. A fencing tool as in claim 8 wherein said handle includes a hammer head located at an opposite side from said first side.

10. A fencing tool as in claim 1 wherein said first attachment includes an opening for receiving a wiring pulling device, and said opening is located at said lower end of said first attachment.

11. A fencing tool as in claim 6 wherein said first wall is longer in length than said second wall to provide for an elongated portion to extend downwardly from said first wall, and said elongated portion includes an opening for receiving a wiring pulling device.

12. A fencing tool as in claim 1 wherein a securing means is attached to said first attachment for providing for said back of said second attachment to be in a locked and secured position when not in use.

* * * * *